United States Patent [19]

Halford

[11] 4,085,026

[45] Apr. 18, 1978

[54] ANODE ASSEMBLY FOR ELECTRODEPOSITION CELL

[75] Inventor: Phillip Charles Halford, Walsall, England

[73] Assignee: Imperial Metal Industries (Kynoch) Limited, Birmingham, England

[21] Appl. No.: 694,324

[22] Filed: Jun. 9, 1976

[30] Foreign Application Priority Data

Jun. 13, 1975 United Kingdom ..... 25383/75

[51] Int. Cl.[2] ..... C25C 7/04; C25B 13/08

[52] U.S. Cl. ..... 204/242; 204/283; 204/290 R

[58] Field of Search ..... 204/282, 283, 295, 296, 204/290 R, 224, 297 R, 242; 429/254

[56] References Cited

U.S. PATENT DOCUMENTS

| | | | |
|---|---|---|---|
| 3,223,611 | 12/1965 | Wells et al. | 204/287 X |
| 3,450,650 | 6/1969 | Murata | 204/296 X |
| 3,563,862 | 2/1971 | Joly et al. | 204/224 R |
| 3,779,887 | 12/1973 | Gildone | 204/224 R |
| 3,918,995 | 11/1975 | Palmer et al. | 429/254 X |
| 3,951,773 | 4/1976 | Claessens et al. | 204/282 X |
| 3,997,421 | 12/1976 | Perri et al. | 204/297 R |

*Primary Examiner*—John H. Mack
*Assistant Examiner*—D. R. Valentine
*Attorney, Agent, or Firm*—Cushman, Darby & Cushman

[57] ABSTRACT

An anode, particularly an anode basket, having on its exterior surface a layer of open, non-woven fibrous mat to protect the anode from accidental contact with a cathode or with an electrically conducting member in contact with the cathode.

10 Claims, 4 Drawing Figures

ANODE ASSEMBLY FOR ELECTRODEPOSITION CELL

BACKGROUND OF THE INVENTION

This invention relates to anodes and has particular, but not exclusive, reference to anodes used in the electrowinning of cobalt.

In cobalt electrowinning, a layer of cobalt is deposited upon a cathode surface in an electrowinning cell. For reasons which are not fully understood, the cobalt layer has a high internal stress which can lead to the layer peeling away from the cathode surface and the cobalt layer coming into contact with the anode. These cathode deposits which peel off are known as "peelers."

A number of proposals have been made to prevent the peeling layer of cobalt coming into contact with the anode. For example, it has been proposed that a layer of canvas be inserted between the anode and the cathode. Unfortunately, however, the electrodeposit continues to grow on the peeler and this grows into the pores of the canvas. When the cathode is removed, the electrodeposit pulls the canvas and can rip or tear it completely clear of the anode. Similar objections apply to plastic meshes or grids.

SUMMARY OF THE INVENTION

By the present invention, there is provided in an electrodeposition cell, an anode having on part at least of its exterior surface a layer of a bonded stereo reticular array of electrically insulating material to protect the anode from accidental contact with a cathode or with an electrically conducting solid member in contact with the cathode.

Preferably the stereo reticular array is formed of a layer of open, non-woven, fibrous mat of resilient fibrous electrically insulating members randomly bonded to each other. The anode may be a basket of a film-forming metal and may be adapted to contain an anodically non-polarisable material. The material may be anodically consumable, or may be an oxygen-evolving material.

The mat may have a thickness in the range 2mm to 50mm.

The mat may be formed of plastics material fibres and may be formed of melded fibres having a higher softening point core and a lower softening point sheath, the mat being bonded together by heating the non-woven mat to a temperature between the softening points of the core and the sheath.

The void volume of the mat may be in the range 99–50%, and is preferably in the range 90–60%.

The exterior of the fibres may be formed of copolyester or copolymer of vinyl chloride, ethylene or propylene with a core of polyester, PVC, polyethylene or polypropylene respectively. The mat may be glued to the anode with the aid of any suitable resistant glue, or may be sewn or fixed with insulating fasteners.

A stereo reticular array comprises a three dimensional array of material in the form of a non-woven fibrous mat or felt and in the form of an open celled foam.

BRIEF DESCRIPTION OF THE DRAWINGS

By way of example, embodiments of the present invention will now be described with reference to the accompanying drawings, of which.

DESCRIPTION OF THE PREFERRED EMBODIMENTS

Figure 1:
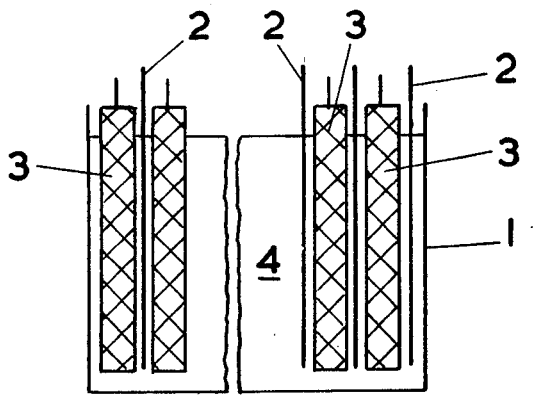
FIG. 1 is a cross-section of a cobalt electrowinning cell.

Referring firstly to FIG. 1, the electrowinning cell comprises a container or vat 1 in which are located alternating cathodes 2 and anode baskets 3. The anode baskets contain a suitable anodic material such as, for example, a cobalt-titanium intermetallic compound. The electrolyte 4 in which the anodes and cathodes are located is principally a cobalt-sulphate liquor.

During operation of the cell in the conventional way, cobalt is deposited on the cathodes 2 and the electrolyte 4 is depleted of cobalt ions. The electro-deposited layer has a high internal stress and as a result, it frequently happens that the cobalt layer peels away from the cathode to form the peeler such as 5, 6 shown in FIG. 2. These peelers can cross the gap between the anode and the cathode to contact the surface of the anode and cause an electrical short between the anode and the cathode.

Figure 2:
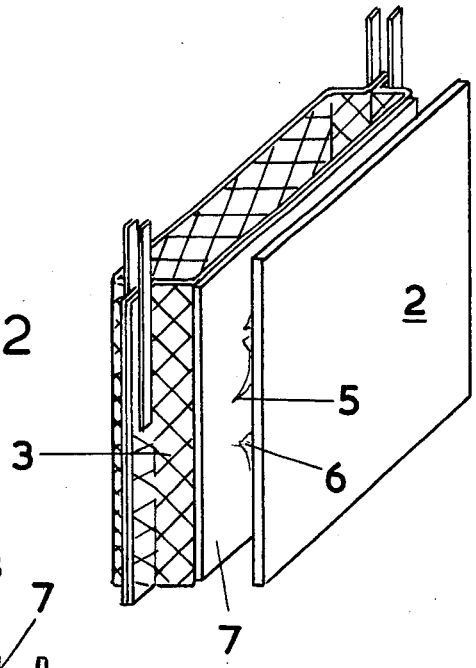
FIG. 2 is a perspective view of an anode and cathode from the cell of FIG. 1.

As can be seen in FIG. 2, the anode basket 3 has on the surface 7 opposite the cathode 2 a layer of open, non-woven, fibrous, electrically insulated members which are randomly bonded to each other where they are in mutual contact to form a mat. This mat prevents direct contact between the peeler and the surface of the anode. The electrodeposition of cobalt onto the tip of the peeler may still continue although probably at a restricted rate because the electrolyte paths near the tip of the peeler are restricted as a result of local compression of the mat at 8. However, when the cathode is removed after a peeler has formed only a small amount of fibres from the mat are pulled away as they are incorporated in the peeler. The mat is not, however, irreparably damaged and only a small loss of material occurs.

The anode baskets may be segmented ie. may have a series of vertical compartments.

In addition to preventing damage by peelers, the mats prevent the escape of impurities from the anodes in much the same way as conventional woven anode gaiters. There is a significant difference in properties between conventional anode gaiters of the woven type and the mats as used according to the invention. In order that woven gaiters restrain a significant proportion of the impurities contained within the anode, they have necessarily a fine pore size. This means that the pores more readily become clogged by the impurities and this results in an electrical resistance which manifests itself as an overvoltage in the electrolytic cell. During measured tests on lead anodes, for example, the voltage measured in an electrolytic cell for electrowinning copper utilizing a lead anode was 1.82 volts, for conventional woven gaiters 0.4 mm thick, it is 2.21 ie plus 21.4% volts whereas for the anode of the invention using a melded fibrous mat, it was 1.93 ie plus 6% volts. Using a needle punched fibrous mat, approximately 2 mm thick, the voltage was 2.01 ie plus 10.4% volts. For large installations this overvoltage represents a complete waste of energy and money and savings of the order of 15% on power costs are extremely significant.

Figure 3:
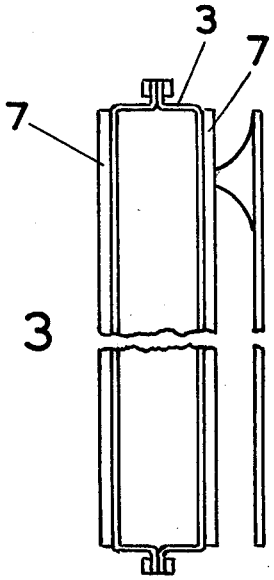
FIG. 3 is a plan view of the anode and cathode of FIG. 2.
Figure 4:
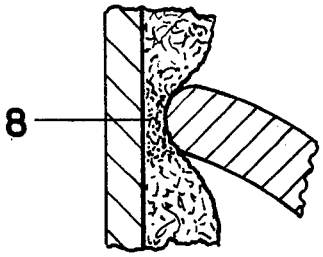
FIG. 4 is an enlarged view of a peeler in contact with a protective mat on an anode basket.

Normally the void volume of the mat which is typically in the range 90/60% is such that the electrolyte and ions move freely through the mat and the mat hardly interferes with the normal operation of the cell. As shown in FIG. 3 the anode basket 3 has a mat on both sides.

Preferably the mat is formed of a melded structure which is manufactured by forming polymers having a sheath of a copolyester of vinyl chloride together with a core of PVC, the sheath having a lower softening point than the core, needle punching the fibres to form a three dimensional array of non-woven but intertangled fibres and heating the array to a temperature between the softening point of the sheath and the core to bond the structure together at those points which fibres touch each other. Clearly the outer polymer needs to be resistant to the electrolyte.

It will be appreciated that in addition to non-woven fibrous mats open celled foams of suitable material may be used and in addition the mats or foams may be used on any anode which may come in contact with a cathode or a cathodically charged member when alloy depositioning is occurring on the cathode or on the member. It is not essential that the anode be a basket and it may, for example, be a conventional anode such as a lead anode.

I claim:

1. An electrodeposition cell including a container for holding an electrolyte, at least one anode and at least one cathode, the or each anode having on at least part of its exterior surface a layer of an open, non-woven fibrous mat of resilient, fibrous electrically insulating members randomly bonded to one another to protect the or each anode from contact with an adjacent cathode or with an electrically conducting solid member in contact with an adjacent cathode.

2. An electrodeposition cell as claimed in claim 1 wherein the or each anode comprises a basket of a film-forming metal for containing an anodically non-polarisable material.

3. An electrodeposition cell as claimed in claim 1 wherein the mat has a thickness in the range 2mm to 50mm.

4. An electrodeposition cell as claimed in claim 1 wherein the mat comprises plastics fibres.

5. An electrodeposition cell as claimed in claim 4 wherein the fibres comprise a higher softening point core and a lower softening point sheath, the fibres having been randomly bonded to each other by heating the non-woven mat to a temperature between the softening points of the core and the sheath.

6. An electrodeposition cell as claimed in claim 1 wherein the mat has a void volume in the range of 99–50%.

7. An electrodeposition cell as claimed in claim 6 wherein the mat has a void volume in the range of 90–60%.

8. An electrodeposition cell as claimed in claim 5 wherein the sheath comprises a material selected from the group consisting of copolyesters, copolymers of vinyl chloride, copolymers of ethylene and copolymers of propylene and the core comprises a material selected from the group consisting of polyesters, PVC, polyethylene and polypropylene respectively.

9. An electrodeposition cell as claimed in claim 1 wherein the mat is attached to the anode by means of glue.

10. An electrodeposition cell as claimed in claim 1 wherein the mat is attached to the anode by means of insulating fasteners.

* * * * *